US006353386B1

(12) United States Patent
Castonguay et al.

(10) Patent No.: US 6,353,386 B1
(45) Date of Patent: Mar. 5, 2002

(54) METHOD AND APPARATUS FOR RETRIEVING LOST GOLF BALLS

(76) Inventors: Roger Castonguay, 5 Ellen Dr., Terryville, CT (US) 06786; Richard Menelly, 18 Saco Rd., Alfred, ME (US) 04002

( * ) Notice: Subject to any disclaimer, the term of this patent is extended or adjusted under 35 U.S.C. 154(b) by 0 days.

(21) Appl. No.: 09/803,546

(22) Filed: Mar. 12, 2001

(51) Int. Cl.[7] ..... G08B 21/00

(52) U.S. Cl. ..... 340/540; 340/545.2; 340/825.36; 340/825.49

(58) Field of Search ..... 340/540, 545.2, 340/825.36, 825.49; 116/214, 209; 73/23.34

(56) References Cited

U.S. PATENT DOCUMENTS 1,664,397 A * 4/1928 Bens ..... 473/353
2,837,912 A * 6/1958 Moncrief ..... 73/23
4,399,687 A * 8/1983 Collins ..... 73/23
5,112,055 A * 5/1992 Barnhill ..... 273/213
5,132,622 A * 7/1992 Valentino ..... 324/326
5,662,533 A * 9/1997 Chadwell ..... 473/353
5,662,534 A * 9/1997 Kroll et al. ..... 473/353
6,002,186 A * 12/1999 Coutu et al. ..... 310/49
6,113,504 A * 9/2000 Kuesters ..... 473/353

* cited by examiner

*Primary Examiner*—Jeffery Hofsass
*Assistant Examiner*—Son Tang

(57) ABSTRACT

The invention comprises a golf ball-locating device in the form of a light aluminum hollow cylinder including a high-speed intake fan and an electronic detection circuit. The detection circuit is conditioned for responding to a particular aroma, to which the golf ball has been previously subjected. Visual and/or audible signals provide indication that the device is in the vicinity of the golf ball.

21 Claims, 2 Drawing Sheets

METHOD AND APPARATUS FOR RETRIEVING LOST GOLF BALLS

BACKGROUND OF THE INVENTION

A problem long associated with the game of golf is the time and inconvenience spent in locating "lost" golf balls, especially with golf beginners.

Many golf courses direct the players to spend no more than a few minutes searching for lost golf balls in order not to delay the following groups of players.

On New England golf courses, with the occurrence of colored leaves upon the change of seasons, visual observation of a golf ball is very difficult.

Although electronic golf ball detecting devices requiring the insertion of a metal chip within the golf ball or a metallic coating on the golf ball surface are currently available, such devices have not realized commercial success.

It would be economically advantageous to the golf player as well as to the golf course management for a golf player to rapidly retrieve his or her golf ball with the minimum amount of time, and without having to expend a substantial amount of money.

One purpose of the instant invention is to describe a simple, inexpensive device for retrieving golf balls, when the golf player has a general indication of the flight of the golf ball prior to impact.

SUMMARY OF THE INVENTION

The invention comprises a golf ball locating device in the form of a light aluminum hollow cylinder including a high-speed intake fan and an electronic detection circuit. The detection circuit is conditioned for responding to a particular aroma, to which the golf ball has been previously subjected. An LED on the top surface of the cylinder turns on by interaction with the air sample that contains the particular odor and becomes increasingly brighter as the locating device approaches the golf ball. An audible signal and/or vibrator could also be employed to provide further indication that the device is in the vicinity of the golf ball.

DESCRIPTION OF THE PREFERRED EMBODIMENT

Figure 1:
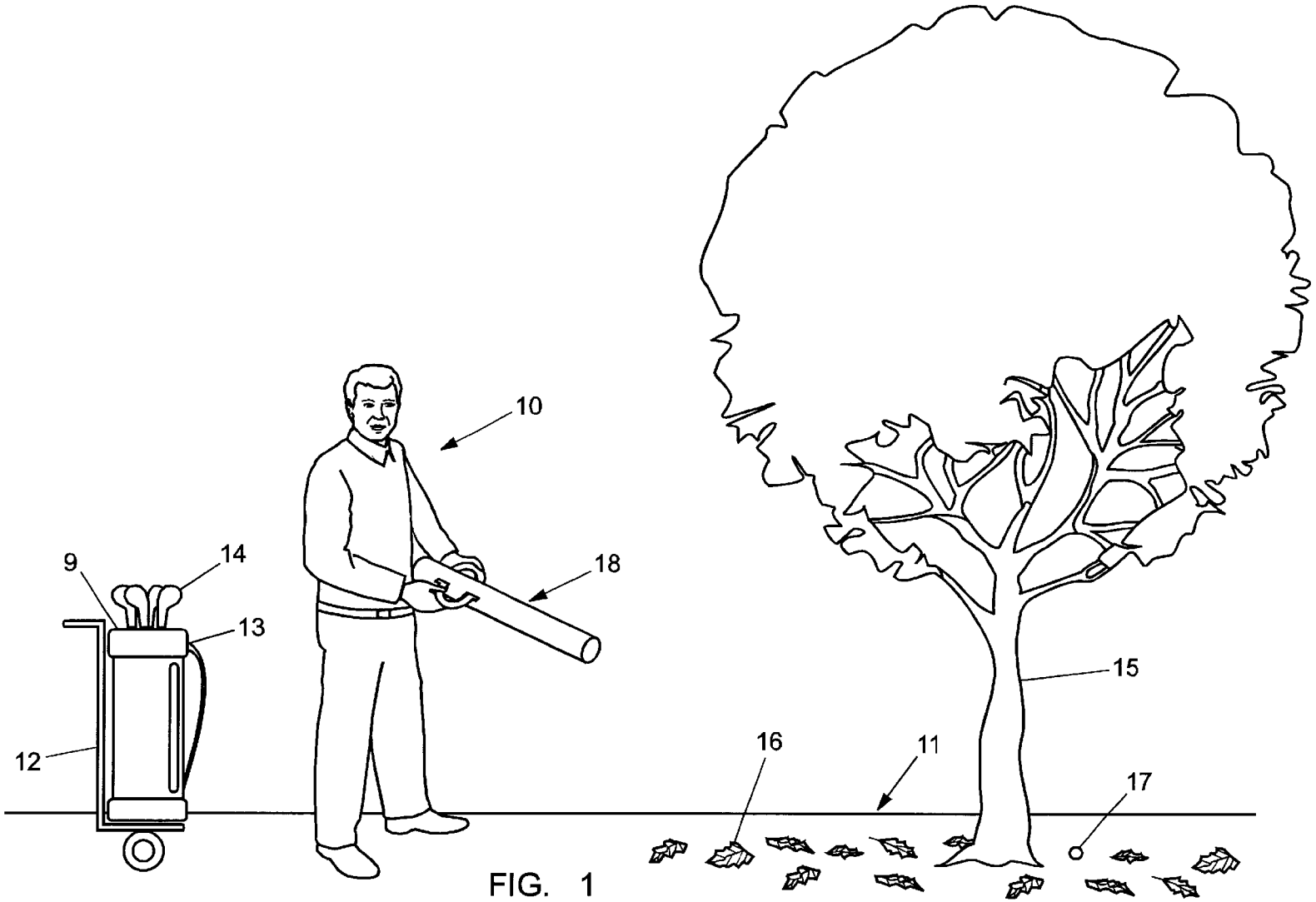
FIG. 1 is a pictorial representation of a golfer employing the golf ball locating device according to the invention.

A golfer 10 is shown in FIG. 1 on a fairway, as generally indicated at 11, next to a golf cart 12 carrying the golfer's clubs 14 in the compartments 9 formed within the golf bag 13 that includes a carrying strap 13. The golf ball 17, which is aroma sensitized in the manner described below, is obscured from view by virtue of the leaves 16 in the vicinity of the tree 15. In order to locate the golf ball 17, the golfer has removed the golf ball detector 18 from one of the compartments 9 in the golf bag and is pointing the detector 18 in the general direction of the golf ball 17. To sensitize the golf ball 17 for detection by the detector, the golf ball may have been previously submerged in a heated solution of vanilla extract of the type that consists of an alcohol solution of vanilla bean extractives. Other substances having a distinct aroma such as ammonia, perfume, turpentine and the like can also be employed depending on the fairway environment.

Figure 2:
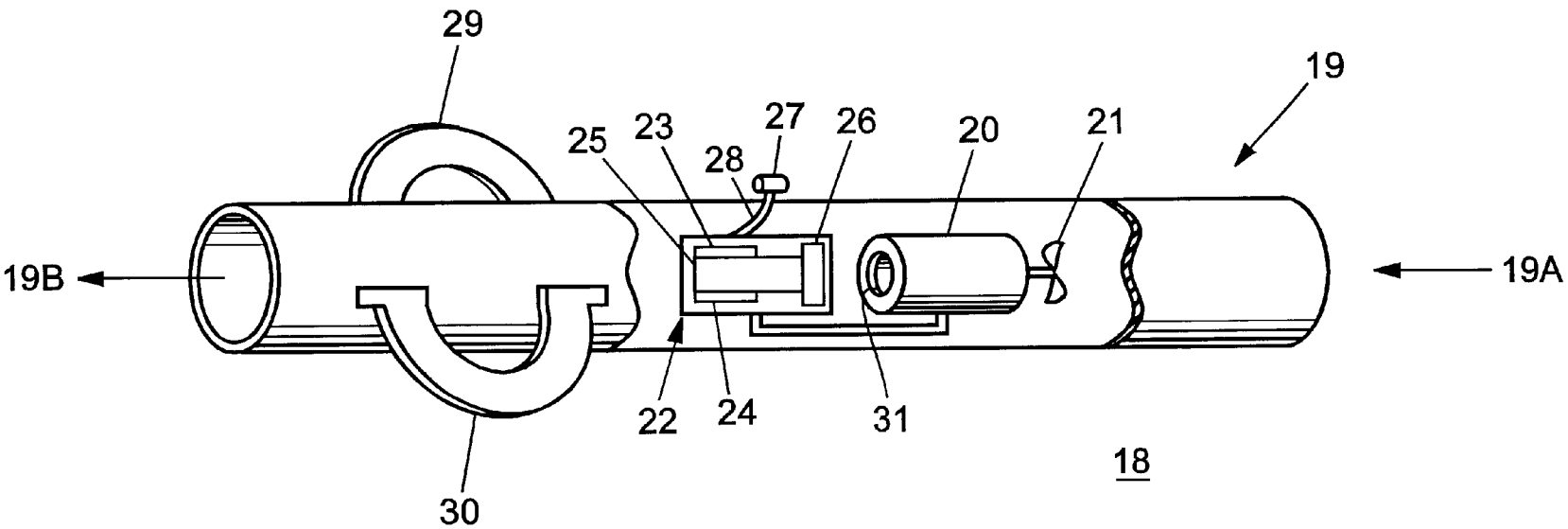
FIG. 2 is an enlarged top perspective view of the golf ball locating device of FIG. 1.

A high-speed intake fan 21, driven by the step motor 20 contained within the hollow aluminum cylinder 10, is shown within the golf ball detector 18 as best seen by now referring to FIG. 2. To facilitate the transfer of the intake air stream indicated at 19A through the step motor 20, a thru hole 31 is provided in the step motor as described within U.S. Pat. No. 6,002,186 entitled "Electric Stepper Motor Having a Cylindrical Magnetic Rotor with a Pair of Cups Made of Magnetic Material". An aroma sensing circuit board 22 of the type including a pair of thermistors 23, 24 electrically interconnected with each other as a bridge circuit shown at 25 and with an external LED 27 via a power supply battery pack 26 and conductors 28. The aroma detection circuit is described within U.S. Pat. No. 4,399,687 entitled "Apparatus for Analyzing and Identifying Odorants" and is located proximate the exhaust end of the stepper motor thru-hole 31. A pair of opposing handles 29, 30 are formed on opposite sides of the hollow cylinder 19 to facilitate holding and aiming the golf ball detector 18 in the direction of the golf ball whereby the intake air exits from the opposite end of the hollow cylinder 19 as indicted at 19B. The cylinder 19 can comprise aluminum or plastic, and can be in the form of a single unit similar to a hair dryer.

As described within the aforementioned U.S. Pat. No. 4,399,687, one of the thermistors 23, 24 is wet with the vanilla solution in order to sensitize the particular thermistor to the odor whereby the resistance of the sensitized thermistor rapidly increases upon adsorption of the vanilla aroma within the intake air stream 19A thereby unbalancing the bridge circuit to turn on the LED 27 by connection with the power supply battery pack 26. The closer the golf ball detector 18 gets to the sensitized golf ball 17 (FIG. 1) the more current transfer occurs between the LED and the power pack to cause the LED to increase correspondingly in brightness and to "point" the golfer in the correct direction. An alternative method for determining the presence a golf ball would be to employ a polymer detector such as the Cyranose 320 sensor sold by Cyrano Inc. whereby the composition of the golf ball, per se, is sufficient odor for detection.

A simple, ineffective golf ball detector has herein been described for locating a lost golf ball on a fairway as well as in the rough, without interfering with the golf ball integrity.

What is claimed is:

1. A golf ball locator comprising:

a portable housing defining an inlet;

detecting means proximate said inlet for detecting a golf ball odor; and means proximate said housing for indicating when said predetermined odor is present within said housing.

2. The locator of claim 1 further including a fan proximate said inlet for drawing exterior air to within said housing.

3. The locator of claim 1 including handle means attached to an exterior of said housing for facilitating manual transfer of said housing.

4. The locator of claim 1 including a golf ball arranged for releasing a predetermined odor whereby said golf ball presence is determined upon detection of said predetermined odor by said detection means.

5. The locator of claim 4 wherein said golf ball is arranged for releasing said predetermined odor by coating said golf ball with a substance characterized by said predetermined odor.

6. The locator of claim 4 wherein said golf ball is arranged for releasing said predetermined odor by saturating said golf ball with a substance characterized by said predetermined odor.

7. The locator of claim 6 wherein said substance is selected from the group consisting of vanilla extract, ammonia and perfume.

8. The locator of claim 1 wherein said detection means includes a first and a second varistor connected within a Wheatstone bridge circuit.

9. The locator of claim 8 including a power source connecting with said first and second varistors and an LED.

10. The locator of claim 9 including an audible signal generator connecting with said first and second varistors.

11. The locator of claim 10 wherein one of said first and second varistors is arranged for adsorbing said predetermined odor and for increasing in resistance value thereby.

12. The locator of claim 1 wherein said housing comprises a hollow cylinder.

13. The locator of claim 1 wherein said detection means includes a polymer.

14. The locator of claim 1 wherein said housing includes an outlet distal said inlet for transfer of said golf ball odor thru said housing.

15. The method of claim 14 wherein the step of providing indication comprises turning on an LED.

16. The method of claim 14 wherein the step of providing indication comprises turning on an audible alarm.

17. The method of claim 16 wherein one of said first and second varistors is coated with said substance containing said predetermined odor.

18. The method of claim 14 wherein said golf ball is characterized by said predetermined odor by coating said golf ball with a substance containing said predetermined odor.

19. The method of claim 14 wherein said circuit includes a pair of first and second thermistors.

20. The locator of claim 1 wherein said housing comprises aluminum or plastic.

21. A method for locating golf balls comprising the steps of:

providing a golf ball characterized by a predetermined odor;

arranging an electric circuit activated by detection of said predetermined odor;

providing indication means connecting with said electric circuit; and arranging said electric circuit proximate said golf ball whereby said electric circuit is activated upon detection of said predetermined odor.

* * * * *